US008522683B2

(12) United States Patent
Heitmann

(10) Patent No.: US 8,522,683 B2
(45) Date of Patent: Sep. 3, 2013

(54) METHOD FOR PRODUCING A SHELL AND A SHELL WITH A SABOT PROJECTILE PRODUCED BY THIS METHOD

(75) Inventor: Thomas Heitmann, Unterluess (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 11 days.

(21) Appl. No.: 12/408,055

(22) Filed: Mar. 20, 2009

(65) Prior Publication Data

US 2011/0000391 A1 Jan. 6, 2011

Related U.S. Application Data

(60) Provisional application No. 61/199,808, filed on Nov. 20, 2008.

(30) Foreign Application Priority Data

Mar. 20, 2008 (DE) ..... 10 2008 015 421

(51) Int. Cl.
*F42B 5/18* (2006.01)

(52) U.S. Cl.
USPC ..... 102/431; 102/521; 102/465

(58) Field of Classification Search
USPC ..... 102/431, 464–466, 522, 524–528; 86/18
See application file for complete search history.

(56) References Cited

U.S. PATENT DOCUMENTS

| | | | | | |
|---|---|---|---|---|---|
| 3,447,466 | A * | 6/1969 | Engel | 102/522 |
| 3,658,008 | A * | 4/1972 | Larson | 102/431 |
| 4,384,529 | A * | 5/1983 | Burns et al. | 102/525 |
| 4,408,538 | A * | 10/1983 | Deffayet et al. | 102/522 |
| 4,444,113 | A * | 4/1984 | Campoli | 102/430 |
| 4,444,115 | A * | 4/1984 | Romer et al. | 102/431 |
| 5,090,323 | A * | 2/1992 | Kallevig et al. | 102/282 |
| 5,138,949 | A * | 8/1992 | Swartout et al. | 102/431 |
| 5,155,295 | A * | 10/1992 | Campoli | 102/430 |
| 5,183,961 | A * | 2/1993 | Campoli et al. | 102/439 |
| 5,189,254 | A * | 2/1993 | Berville et al. | 102/521 |
| 5,277,096 | A * | 1/1994 | Campoli et al. | 86/1.1 |
| 5,277,120 | A * | 1/1994 | Campoli et al. | 102/470 |
| 5,277,121 | A * | 1/1994 | Campoli et al. | 102/521 |
| 5,359,938 | A * | 11/1994 | Campoli et al. | 102/521 |
| 5,841,062 | A * | 11/1998 | Manole et al. | 102/431 |
| 6,012,394 | A * | 1/2000 | Dion et al. | 102/443 |
| 6,295,934 | B1 * | 10/2001 | Tepera et al. | 102/525 |
| 6,477,958 | B1 * | 11/2002 | Leblond et al. | 102/439 |

(Continued)

FOREIGN PATENT DOCUMENTS

| | | | |
|---|---|---|---|
| DE | 10055068 | * | 5/2002 |
| EP | 0307307 A1 | * | 3/1989 |

(Continued)

*Primary Examiner* — Jonathan C Weber
(74) *Attorney, Agent, or Firm* — Lucas & Mercanti, LLP; Klaus P. Stoffel

(57) ABSTRACT

A method for producing a shell and a shell produced by this method, wherein the shell has a projectile, a combustible propellant charge casing, and a casing cover that joins the propellant charge casing with the projectile, such that the projectile has a sealing ring adjacent to the casing cover. To realize cost-effective assembly of a shell of this type, the casing cover is produced as an injection molded part made of an elastic plastic, such that the front end region of the casing cover facing the projectile forms the sealing ring.

7 Claims, 2 Drawing Sheets

(56) References Cited

U.S. PATENT DOCUMENTS

| | | | | |
|---|---|---|---|---|
| 6,626,113 | B1 * | 9/2003 | Gilman et al. | 102/444 |
| 6,748,870 | B2 * | 6/2004 | Heidenreich et al. | 102/431 |
| 6,988,450 | B1 * | 1/2006 | Georgantzis et al. | 102/401 |

FOREIGN PATENT DOCUMENTS

| | | | |
|---|---|---|---|
| EP | 1103780 | A1 * | 5/2001 |
| EP | 1586852 | A1 * | 10/2005 |
| FR | 2878025 | A1 * | 5/2006 |

* cited by examiner

METHOD FOR PRODUCING A SHELL AND A SHELL WITH A SABOT PROJECTILE PRODUCED BY THIS METHOD

The present application claims priority from U.S. Provisional Patent Application No. 61/199,808 filed Nov. 20, 2008, the entire contents of which are incorporated by reference.

BACKGROUND OF THE INVENTION

The invention concerns a method for producing a shell with a projectile, a combustible propellant charge casing, and a casing cover that joins the propellant charge casing with the projectile. The projectile has a sealing ring adjacent to the casing cover. The invention also concerns a shell that has a sabot projectile.

Especially in the case of large-caliber tank ammunition with a combustible propellant charge casing, the propellant charge casing is usually connected to the projectile by means of a casing cover, which can consist of a combustible material (for example, nitrated, resin-impregnated cardboard) or an inert material (for example, nonnitrated resin-impregnated cardboard). In addition, tank ammunition requires a deformable sealing ring to prevent propellant gases from flowing past the projectile during its passage through the gun barrel.

One of the disadvantages of the previously known methods is that the assembly of the shells is relatively time-consuming and expensive, because separate production lines are necessary for the mounting of the casing cover and the mounting of the sealing ring. For example, the casing cover is joined with the rear region of the projectile body by a bolted joint or an adhesive joint, while the separate sealing ring, which is made of metal or plastic, is either pressed or injected into an annular groove provided for it in the projectile and then must be aftertreated.

SUMMARY OF THE INVENTION

The object of the invention is to provide a method of the aforementioned type that allows more cost-effective assembly than comparable prior-art methods for producing shells with a casing cover. Another object of the invention is to provide a shell with a sabot projectile that is produced by this method.

The invention is based essentially on the idea of producing the casing cover as an injection molded part made of an elastic plastic, such that the front end region of the casing cover facing the projectile forms the sealing ring of the projectile.

The integration of the sealing ring in the casing cover allows simple assembly of the shell. In addition, the replacement of the relatively brittle and abrasion-sensitive material used for the casing cover in previously known shells by an elastic plastic means that the total assembly consisting of the casing cover, projectile, and propellant charge casing is less susceptible to fracture and cracking than similar, previously known assemblies, since the elastic plastic absorbs deformational energy. Furthermore, with a plastic easing cover, unintended ignition of the casing cover does not occur if the casing cover rubs against parts of the gun during loading and unloading. In addition, the protective coating needed with previously known casing covers can usually be dispensed with here.

The casing cover is preferably provided with an annular rated break point between the region serving as the sealing ring and the region adjacent to it towards the rear end, so that upon discharge, the casing cover separates along the rated break points as the projectile passes into the bore of the gun barrel. The remnants of the casing cover remaining in the area of the loading chamber of the gun barrel are then expelled from the muzzle end of the barrel by the propellant charge gases.

The area of the casing cover that serves as the sealing ring can be pressed or shrunk onto the projectile or can be fastened to the projectile by adhesive bonding.

It can also be provided for the area of the casing cover that serves as the sealing ring to be fastened to the projectile by a locknut.

Further details and advantages of the invention are apparent from the following specific examples, which are illustrated by the accompanying drawings.

DETAILED DESCRIPTION OF THE INVENTION

Figure 1:
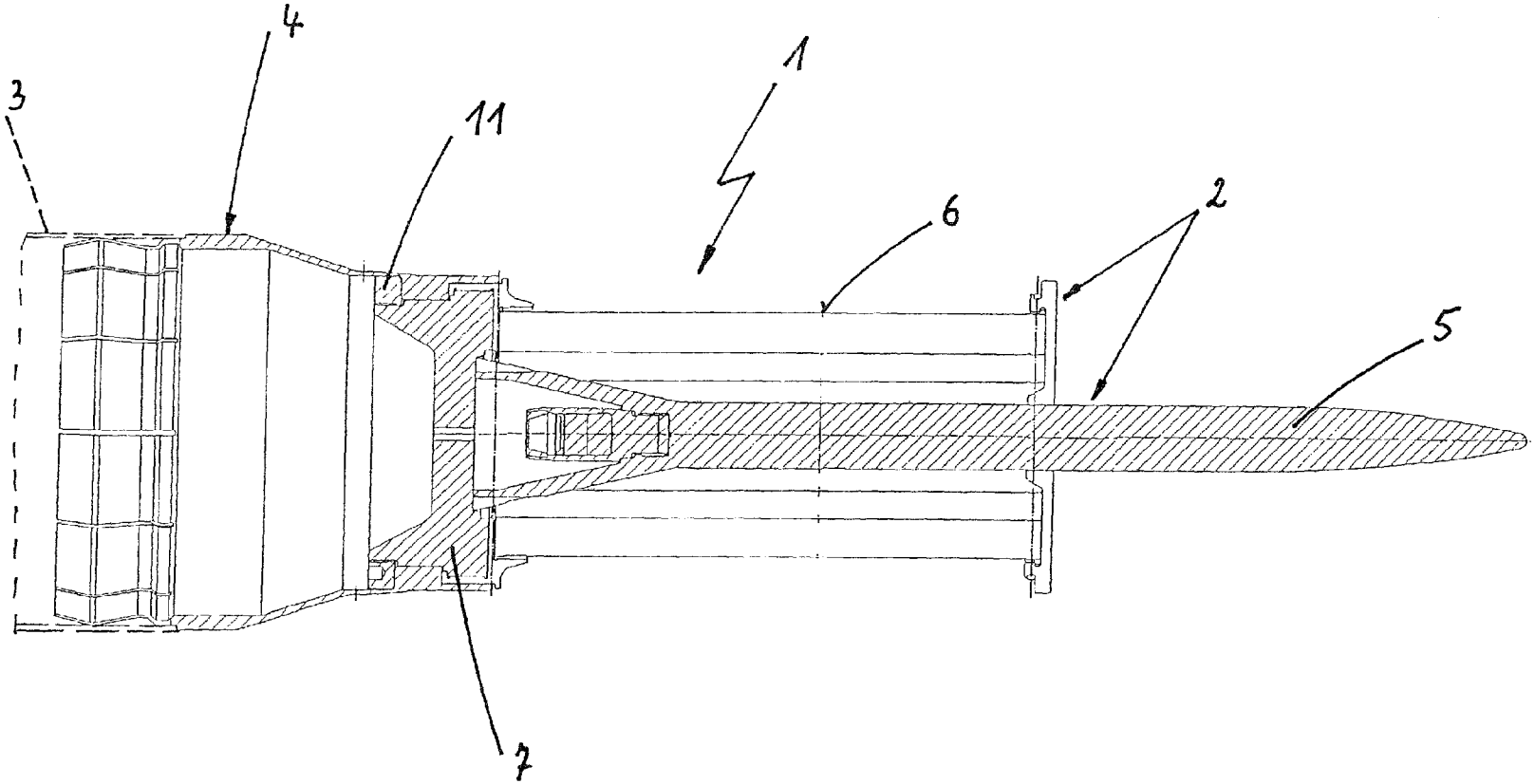
FIG. 1 is a longitudinal section through the projectile end of a shell of the invention with a sabot projectile and a casing cover.

FIG. 1 shows a shell 1 to be fired from a large-caliber smooth-bore cannon. It comprises a sabot projectile 2, a propellant charge casing 3, which is merely indicated by broken lines, and a casing cover 4, which joins the propellant charge casing 3 and the sabot projectile 2. The sabot projectile 2 consists basically of a subcaliber penetrator 5 and a discarding sabot 6. In the illustrated embodiment, the sabot 6 is a cup sabot with a plate-shaped propulsion element 7 acting from the rear end on the subcaliber penetrator 5.

Figure 2:
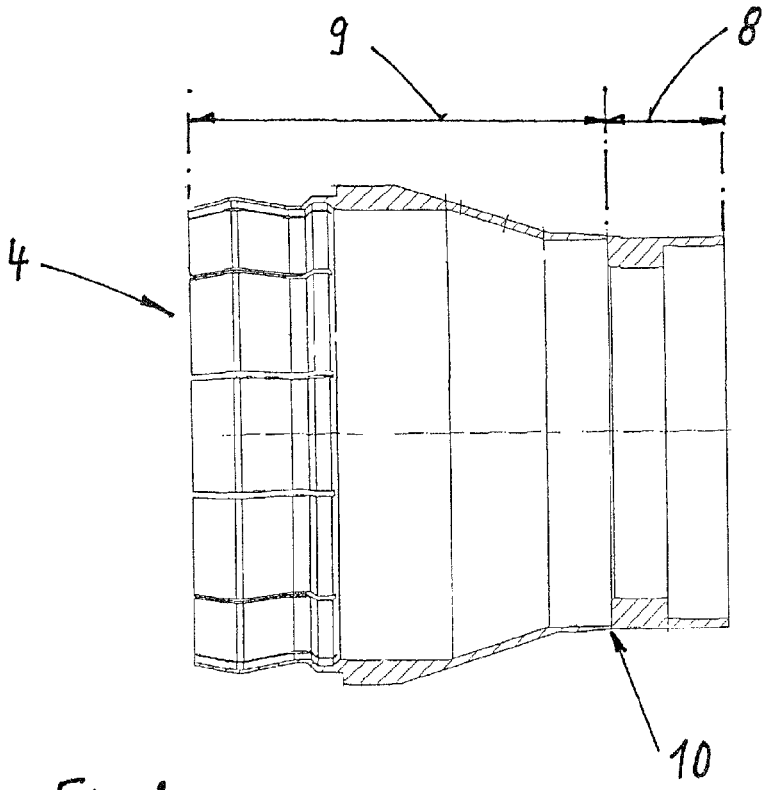
FIG. 2 is an enlarged view of the casing cover shown in FIG. 1.
Figure 3:
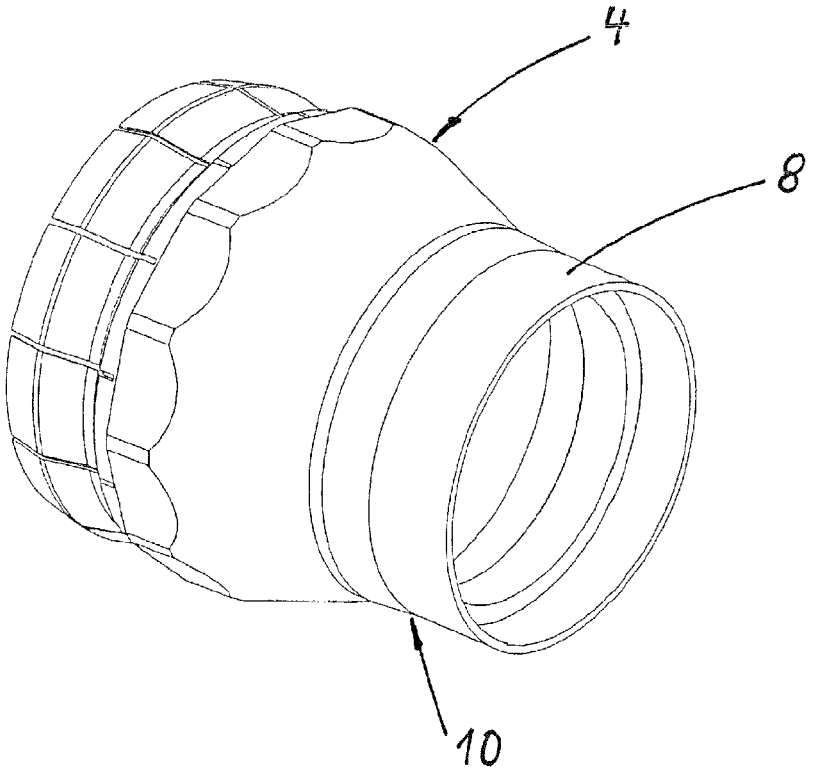
FIG. 3 is a perspective view of the casing cover shown in FIG. 2.

In accordance with the invention, the casing cover 4 is an injection molded part made of an elastic plastic, whose front end region 8 (FIG. 2) encloses the propulsion element 7 of the sabot 6 and forms the sealing ring of the sabot projectile 2.

To ensure definite separation of the sabot projectile 2 from the propellant charge casing 3 during discharge, an annular rated break point 10 is provided between the front end region 8 of the sealing ring and the adjacent rear end region 9. This rated break point 10 is preferably arranged in such a way that when the shell 1 is loaded in a cannon, the rated break point 10 is located in the area of the conical transition to the loading chamber of the cannon, so that when the cannon is fired, the casing cover 4 separates along the rated break points 10 as the sabot projectile 2 passes into the bore of the gun barrel. The remnants of the casing cover 4 remaining in the area of the loading chamber of the gun barrel are then expelled from the muzzle end of the barrel by the propellant charge gases.

In the embodiment illustrated in FIG. 1, the casing cover 4 is fastened on the sabot projectile 2 by a locknut 11 screwed onto the rear end of the plate-shaped propulsion element 7.

Naturally, the invention is not limited to the specific embodiment described above. For example, the shell is not necessarily one which has a tailpiece-stabilized sabot projectile, but rather the method of the invention can also be used, for example, for shells with a tailpiece-stabilized equal-caliber projectile body. In this case, the region of the casing cover that serves as the sealing ring can be fastened to the usually conically constructed region of the tailpiece holder that faces the projectile body.

The invention claimed is:

1. A method for producing a shell with a projectile, a combustible propellant charge casing, and a casing cover that joins the propellant charge casing with the projectile, where the projectile has a sealing ring adjacent to the casing cover, the method comprising the steps of: producing the casing cover by injection molding with an elastic plastic, such that a front end region of the casing cover facing the projectile forms the sealing ring; joining the casing cover with the propellant charge casing and the projectile; and providing an annular rated break point in the casing cover so as to be between the front end region and an adjacent rearward main body portion of the casing cover, so that upon ignition of the propellant charge the casing cover separates along the annular break point whereby the front end region forms the sealing ring of the projectile passing through a weapon barrel, and the rearward main body portion of the casing cover is forced out of a mouth of the weapon barrel by drive gases, wherein the front end region has an axial length substantially smaller than an axial length of the rearward main body of the casing cover.

2. The method in accordance with claim 1, including pressing or shrinking the region of the casing cover that forms the sealing ring onto the projectile.

3. The method in accordance with claim 1, including fastening the region of the casing cover that forms the sealing ring to the projectile by adhesive bonding.

4. The method in accordance with claim 1, including fastening the region of the casing cover that forms the sealing ring to the projectile by a locknut.

5. A shell, comprising: a projectile that includes a subcaliber penetrator and a discarding sabot; a combustible propellant charge casing; and a casing cover that joins the propellant charge casing with the sabot, wherein the sabot has a sealing ring adjacent to the casing cover, the casing cover being an injection molded part made of an elastic plastic and the sealing ring being formed by a front end region of the casing cover, an annular break point being provided in the casing cover between the front end region and an adjacent rearward main body portion of the casing cover, so that upon ignition of the propellant charge the casing cover separates along the annular break point whereby the front end region forms the sealing ring of the projectile passing through a weapon barrel, and the rearward main body portion of the casing cover is forced out of a mouth of the weapon barred by drive gases, wherein the front end region has an axial length substantially smaller than an axial length of the rearward main body of the casing cover.

6. The shell in accordance with claim 5, wherein the sabot is a cup sabot with a plate-shaped propulsion element that acts on a rear end of the subcaliber penetrator, wherein the front end region of the casing cover that serves as the sealing ring encloses the propulsion element.

7. The shell in accordance with claim 5, and further comprising a locknut arranged to fasten the sealing ring to the projectile.

* * * * *